United States Patent [19]

Moffatt

[11] 4,113,257

[45] Sep. 12, 1978

[54] GOLF PRACTICE DEVICE

[76] Inventor: Clinton D. Moffatt, 5610 Flagstone St., Long Beach, Calif. 90808

[21] Appl. No.: 732,318

[22] Filed: Oct. 14, 1976

[51] Int. Cl.[2] ..... A63B 69/36

[52] U.S. Cl. ..... 273/185 C; 273/198; 273/200 R; 273/58 C; 273/58 E; 273/58 B; 273/197 A

[58] Field of Search ..... 273/200 R, 200 A, 200 B, 273/58 B, 58 BA, 58 C, 58 E, 185 R, 185 C, 185 D, 196, 197 R, 197 A, 198

[56] References Cited

U.S. PATENT DOCUMENTS 1,399,293 12/1921 Craig ..... 273/200 R 2,929,632 3/1960 Moffatt ..... 273/200 R X

*Primary Examiner*—George J. Marlo

*Attorney, Agent, or Firm*—William C. Babcock

[57] ABSTRACT

An improved golf practice device of the type in which a tethered hollow ball formed from a resilient material rotates about a horizontal axis when struck by a golf club head, with the hollow ball being permanently held in a fixed position on the free end portion of the cord to which it is secured, and the ball due to being diametrically compressed and the positioning of apertures therein emitting a sound when impacted by a golf club head that is similar to that when an actual golf ball is hit by a golf club head.

4 Claims, 7 Drawing Figures

GOLF PRACTICE DEVICE

BACKGROUND OF THE INVENTION

1. Field of the Invention

Improved Golf Practice Device.

2. Description of the Prior Art

A prior art golf club practice device of the type in which a tethered hollow resilient ball rotates about a horizontal axis when the ball is struck by a golf club head is shown and described in my prior U.S. Pat. No. 2,929,632 that issued Mar. 22, 1960, entitled "Golf Practice Device." This prior art device while highly satisfactory for golf practice, has the operational disadvantages that the hollow resilient ball tends to move longitudinally on the tethering cord after repeated impacts, and the ball when struck emitting a sound that in no way resembles the sound of a golf club head contacting an actual golf ball.

A major object of the invention is to provide an improved golf practice device that will eliminate operational disadvantages of my prior invention, and one that simulates the effect that is achieved when a real golf ball is hit with a club head.

Another object of the invention is to provide a method of so mounting a resilient hollow golf ball replica on an end portion of a tethering cord that the ball will not move longitudinally on the cord after repeated impacts of a golf club head on the replica.

A further object of the invention is to supply a golf ball replica that may be diametrically compressed to emit a sound similar to that of a real golf ball when the latter is struck with a golf club head, and the replica having a number of holes so disposed therein that wind resistance slows down rotation of the replica and tethering cord after the replica is impacted with a golf club head.

SUMMARY OF THE INVENTION

The invention includes an L-shaped support that includes a first vertical leg and a second horizontal leg. The first leg is held at a desired fixed location above the ground surface or floor by a suitable base. A ring shaped member engages a first looped end portion of a tethering cord. The ring-shaped member is rotatably supported on the second horizontal leg adjacent a free end thereof, and is situated between first and second protuberances that are spaced from one another a distance greater than the thickness of the ring shaped member.

The resilient golf ball replica has diametrically aligned first and second bores therein in which first and second tubular resilient grommets are disposed that positively engage edge portions of the golf ball replica. A first tubular flanged fastener is mounted on the tethering cord, and the cord is then extended through the first and second grommets. A second tubular flanged fastener is mounted on the free end of the tethering cord. The tubular portions of the first and second fasteners are permanently deformable when a force is applied transversely thereto.

The tubular portion of the second fastener is now crimped to permanently deform the same and secure it in a fixed position to the tethering cord. The golf ball replica now has a force exerted thereon substantially parallel to the portion of the tethering cord that extends therethrough, with this force temporarily deforming the golf ball replica to an oblate configuration. The first fastener is now moved downwardly on the cord to abut against the first grommet, and with the tubular portion being crimped into a fixed position on the tethering cord. The golf ball replica is now allowed to expand. The golf ball replica after expansion will have a flat portion adjacent the first grommet, and the golf ball replica between the first and second fasteners being diametrically deformed to tension at least the center circumferential portion of the golf ball replica. The portion of the golf ball replica adjacent the first grommet has a number of circumferentially spaced openings therein that provide wind resistance when the tethered golf ball replica is rotated.

The first and second fasteners not only serve to hold the golf ball replica in a fixed position on the free end portion of the tethering cord, but also serve to diametrically deform the golf ball replica so that at least the center circumferential portion is subjected to tension. The tensional center portion of the golf ball replica tends to resist deformation when impacted by a golf club head. Due to the tensioned center portion, and the golf ball replica being formed from a resilient polymerized resin in which no openings are formed, the golf ball replica when struck by a golf club head emits a sound that is similar to that of a real golf ball when the latter is driven.

DESCRIPTION OF THE PREFERRED EMBODIMENT

Figure 1:
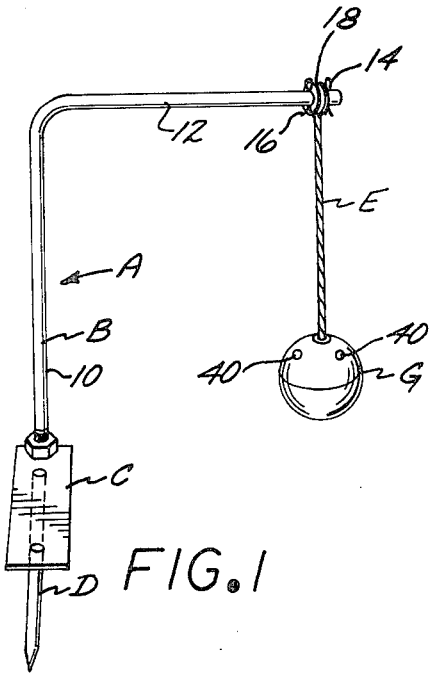
FIG. 1 is a perspective view of the improved golf practice device.

The improved golf practice device A as shown in FIG. 1 includes a support B secured to a base C from which at least one prong D extends downwardly. The prong D may be driven into the ground to maintain the support B at a fixed position thereon. In the event that the device A is to be used indoors, the base B will be a flat rectangular sheet (not shown) from which the base B extends upwardly. Irrespective of the type of the base B that is used, the device A operates in the same manner to produce the same results.

The support B includes a first vertically extending leg 10 that supports a second leg 12 that is horizontally disposed from the upper portion thereof. First and second pins 14 and 16 extend through transverse bores (not shown) in the free end portion of second leg 12. The first and second pins 14 and 16 are separated by a distance 18.

Figure 2:
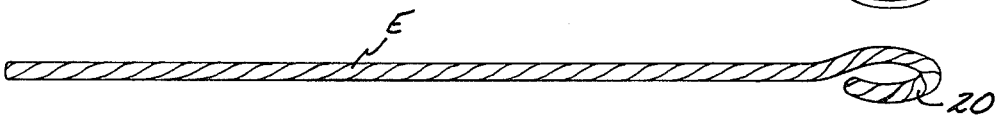
FIG. 2 is an exploded perspective view of a looped end portion of a tethering cord prior to being secured to two ring shaped members.

A pliable tethering cord, E is provided as shown in FIG. 2 that has a loop 20 in a first end thereof, which loop is permanently engaged by first and second interlocking ring shaped members 22 and 24 that cooperate to define a rotatable member F. The rotatable member F has an opening 26 therein that is of greater cross sectional area than the cross sectional area of the second leg 12. The thickness of rotatable member F is less than the distance 18 between first and second pins 14 and 16.

A hollow replica G of a golf ball is provided that is molded from a resilient polymerized resin, and is preferably of a color that contrasts with the ground surface and base C. The replica G has two diametrically aligned bores 30 formed therein that are engaged by first and second grooved resilient grommets 32 and 34 that have first and second interiorly disposed openings therein.

Figure 4:
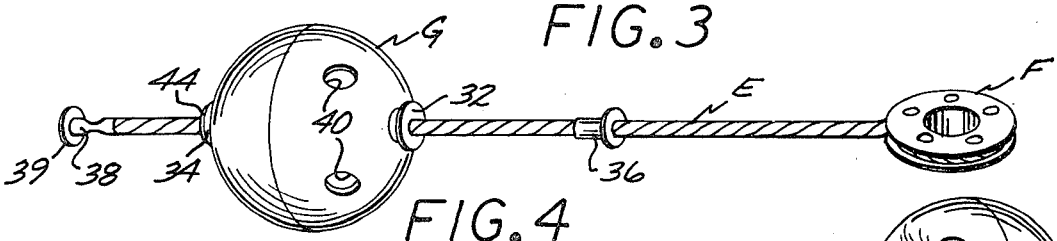
FIG. 4 is a perspective view of the tethering cord extending diametrically through the golf ball replica, the first and second grommets mounted on the golf ball replica, the second fastener permanently secured to the tethering cord, and the first fastener longitudinally movable on the tethering cord.
Figure 5:
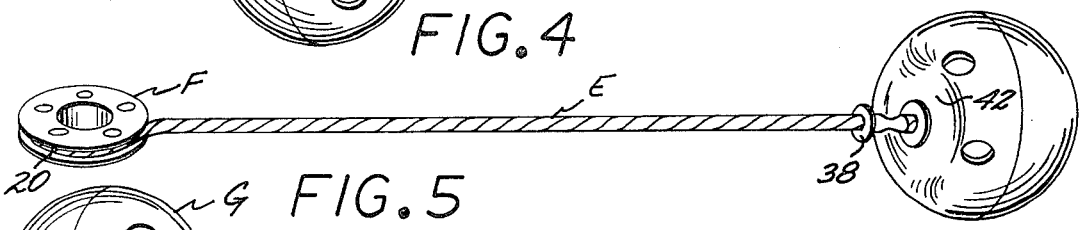
FIG. 5 is a perspective view of the first end portion of the golf ball replica being deformed to define a concavity prior to the first fastener being crimped to the tethering cord.
Figure 6:
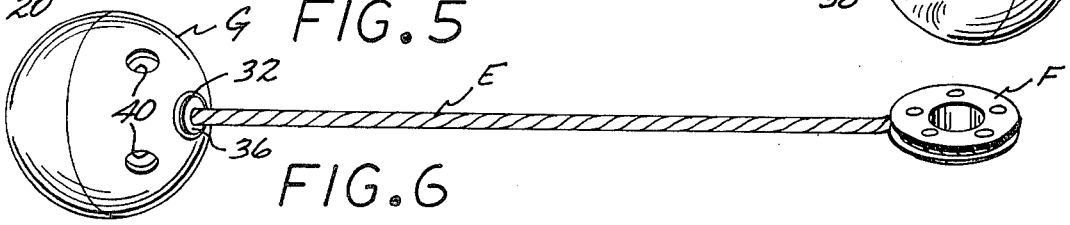
FIG. 6 is a perspective view of the tethering cord, with the golf ball replica mounted in a fixed diametrically deformed position thereon.

The tethering cord E as shown in FIG. 2 has a first flanged tubular fastener 36 mounted thereon and slid to the position thereon as shown in FIG. 4. The tubular portion of first fastener 36 is transversely deformable and may be crimped into gripping engagement with the tethering cord E. The tethering cord is threaded through the first and second openings as shown in FIG. 4 and a second fastener 38 identical to the first fastener 36 is crimped to the free end of the tethering cord.

The replica G adjacent the first grommet 32 has a number of circumferentially spaced openings 40 formed therein that provide wind resistance to slow down rotation of the tethering cord E and replica G about the second leg 12 after the replica is struck by a golf club head (not shown). The openings 40 also render the portion of the replica G adjacent thereto sufficiently resilient that when the rotatable member F is grasped by one hand and the replica by the other hand, and the two hands moved away from one another a concavity 42 may be formed in the replica adjacent the first grommet 32. When the concavity 42 is so formed the first fastener 36 is slid downwardly therein, and the first fastener crimped to the tethering cord. The force on the concavity 42 in the replica G is released, and the portion 42 now attempts to return to its initial shape. However, due to the placement of the first fastener 36 on the tethering cord E, the portion 42 is slightly flat adjacent the first grommet 32 as may be seen in FIG. 7.

The first and second fasteners 36 and 38 and first and second grommets 32 and 34 after the above described operation is performed cooperate to shorten the diameter between the two bores 30, with the replica G being diametrically compressed. The compression of the replica G results in the circumferential center portion of the replica being tensioned and at all times tending to bow outwardly. As a result when the replica G is supported by the tethering cord E as shown in FIG. 1, and the tensioned portion of the replica is struck by a golf club head, the replica will emit a sound that is similar to that which occurs when a golf club head hits an actual golf ball.

The invention A is used in the same manner as the device disclosed and claimed in my prior U.S. Pat. No. 2,929,632. After the prong D is forced into the ground, the support B will be disposed as shown in FIG. 1 with the tethering cord E and replica G depending from the second leg 12. The player may then strike the replica G with a golf club in a conventional manner, but always bearing in mind that the shaft of the club must clear the second leg 12. In the event the club head strikes the replica G correctly, replica G, tethering cord E, and member F will rotate in a vertical plane, with the openings 40 providing sufficient wind resistance as to terminate the rotation after a few turns. However, if a right-handed player (not shown) is standing facing the replica G and strikes the replica as to cause it to hook, the replica, cord E and member F will be in an inclined plane in which the lower part thereof extends inwardly towards the first leg 10. If the blow imparted to the replica G is such as would impart a slice to a real golf ball, the plane of rotation of the replica, cord and fastener will be in an angular plane that has the lower portion thereof extending away from the first leg 10. Irrespective of the plane in which replica G, cord E and fastener F rotate, the impact of the golf club head (not shown) with the replica will result in the replica emitting a sound similar to that which occurs when a real golf ball is struck.

Figure 7:
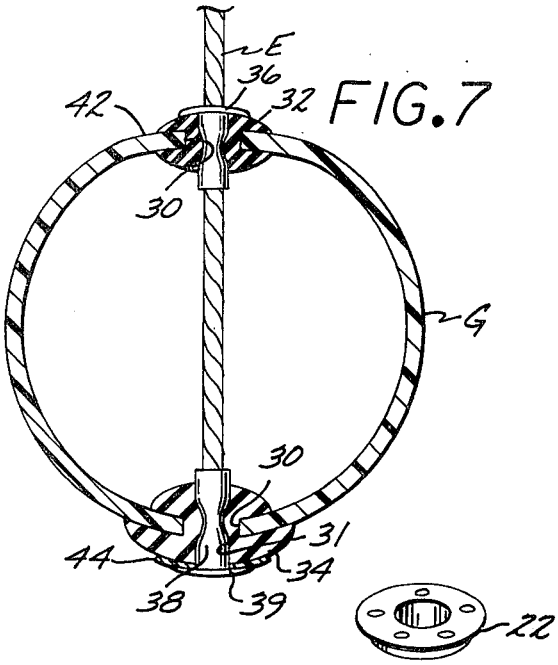
FIG. 7 is a transverse cross-sectional view of the golf ball replica held in a fixed position on an end portion of a tethering cord by first and second fasteners, and the fasteners also serving to hold the golf ball replica tensioned.
Figure 3:
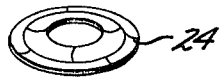
FIG. 3 is a perspective view of the components shown in FIG. 3 after the two ring shaped members have been placed in engagement with the loop in the tethering cord.
Figure 3:
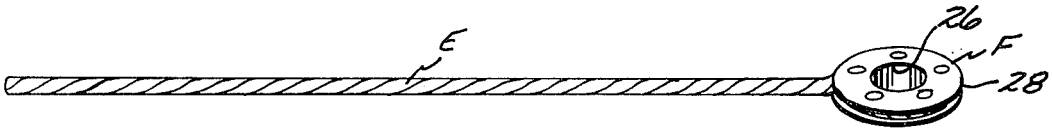

To prevent the flange 39 on second fastener 38 pulling through the bore 31 in second bore 30 when the replica G is subjected to a force to form the concavity 42 therein, I have found it desirable to interpose a flat, thin, rigid washer 44 between the flange and the outer surface of the second grommet 34 as shown in FIGS. 3 and 7. The washer 44 is preferably of substantially the same transverse cross-sectional area as that of second grommet 34.

The use and operation of the invention has been described previously in detai and need not be repeated.

I claim:

1. A golf practice device of the type that includes a base, an inverted L-shaped support that extends upwardly from said base, a rotatable member mounted on said support, a tethering cord secured to said rotatable member, a hollow resilient spherical shell that is a replica of a golf ball and is adapted to be hit with a golf club head, which shell has first and second diametrically aligned bores therein in which first and second resilient grommets are disposed through which a free end portion of said tethering cord extends, said golf practice device being characterized by including:

first and second fasteners on said tethering cord that are in abutting contact with said first and second grommets, with said first and second fasteners so longitudinally spaced on said tethering cord that said shell is diametrically compressed therebetween to circumferentially tension the portion of said shell that will be struck by said golf club head when said device is used for golf practice, with said shell when struck by said golf club head due to said tensioning, emitting a sound that is similar to the sound emitted by a real golf ball when impacted by a golf ball head, said shell having a plurality of circumferentially spaced openings therein adjacent one of said first or second grommets, with said opening serving the dual functions of creating sufficient wind resistance after said shell has been struck by a golf club head that said rotatable member, tethering cord and shell will stop rotating concurrently as a unit after a few turns, and said openings so weakening the portion of said shell in which they are formed that said shell may be diametrically compressed between said first and second fasteners.

2. A golf practice device as defined in claim 1 which in addition includes a flat rigid washer that engages said tethering cord and is interposed between said second grommet and said second fastener to prevent said second fastener from being pulled through said second grommet.

3. A golf practice device as defined in claim 2 in which said second fastener includes a tubular portion secured to said tethering cord and an outwardly extending flange, with said washer in abutting contact with said flange and said second grommet.

4. A golf practice device as defined in claim 3 in which said washer is of substantially the same transverse cross sectional view as that of said second grommet.

* * * * *